US006536684B1

(12) United States Patent
Wei

(10) Patent No.: US 6,536,684 B1
(45) Date of Patent: Mar. 25, 2003

(54) PIVOTABLE CONNECTION DEVICE FOR CONNECTING PAINT CUP TO PAINT SPRAYER

(76) Inventor: Hsueh Li Wei, No. 47, Feng An St., Nantuen Chiu, Taichung (TW)

( * ) Notice: Subject to any disclaimer, the term of this patent is extended or adjusted under 35 U.S.C. 154(b) by 0 days.

(21) Appl. No.: 10/166,787

(22) Filed: Jun. 11, 2002

(51) Int. Cl.[7] ..... B05B 9/03

(52) U.S. Cl. ..... 239/302; 239/345; 239/375; 239/376; 239/377; 239/378; 239/379

(58) Field of Search ..... 239/302, 345, 239/375, 376, 377, 378, 379, DIG. 14

(56) References Cited

U.S. PATENT DOCUMENTS 3,003,704 A * 10/1961 Roche ..... 239/345
3,236,459 A * 2/1966 McRitchie ..... 239/416
5,069,389 A * 12/1991 Bitsakos ..... 239/289
6,092,740 A * 7/2000 Liu ..... 239/346

* cited by examiner

*Primary Examiner*—Robert M. Fetsuga
*Assistant Examiner*—Lina R Kontos
(74) *Attorney, Agent, or Firm*—Charles E. Baxley

(57) ABSTRACT

A paint sprayer includes a body having a connection hole on a top thereof and a trigger device is pivotably connected to the body. A hose fitting is connected to a handle of the body so as to be connected with a compressor. A connection device is pivotably connected between the body and a paint cup such that the paint cup is pivotable relative to the body so that the surface of the paint in the paint cup can be maintained at horizontal whatever angle the sprayer is operated.

1 Claim, 5 Drawing Sheets

PIVOTABLE CONNECTION DEVICE FOR CONNECTING PAINT CUP TO PAINT SPRAYER

FIELD OF THE INVENTION

The present invention relates to a connection device which is pivotably connected between a paint cup and a paint sprayer so as to adjust the paint cup when the sprayer is used at an angle.

BACKGROUND OF THE INVENTION

A conventional paint sprayer 1 is shown in FIG. 1 and generally includes a sprayer body which has a fitting 13 connected to the handle of the sprayer so as to be connected with a compressor to send pressurized air into the body. A nozzle 11 is connected to a front end of the body and a paint cup 14 is connected to the barrel of the body by a connection neck 141. The pressurized air sends the paint 15 in the paint cup 14 out from the nozzle 11 by pulling the trigger 12 which controls a valve means in the body. When the sprayer 1 is used an angle such as when spraying at a vertical wall, the body of the sprayer 1 is used at an angle relative to the ground and the surface of the paint 15 is inclined to include a low point and a high point. When the low point is lower than the opening of the connection neck 141, no paint can be sucked in the body to be sprayed out. It has the same shortcoming when using the sprayer downward.

The present invention intends to provide a connection device that is connected to the paint cup and pivotable relative to the body of the sprayer so that the surface of the paint in the paint cup can be maintained in horizontal regardless of the angle of use of the sprayer.

SUMMARY OF THE INVENTION

In accordance with one aspect of the present invention, there is provided a paint sprayer includes a body having a connection hole on a top thereof so as to be pivotably connected to a connection device which is pivotably connected between the body and a paint cup.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
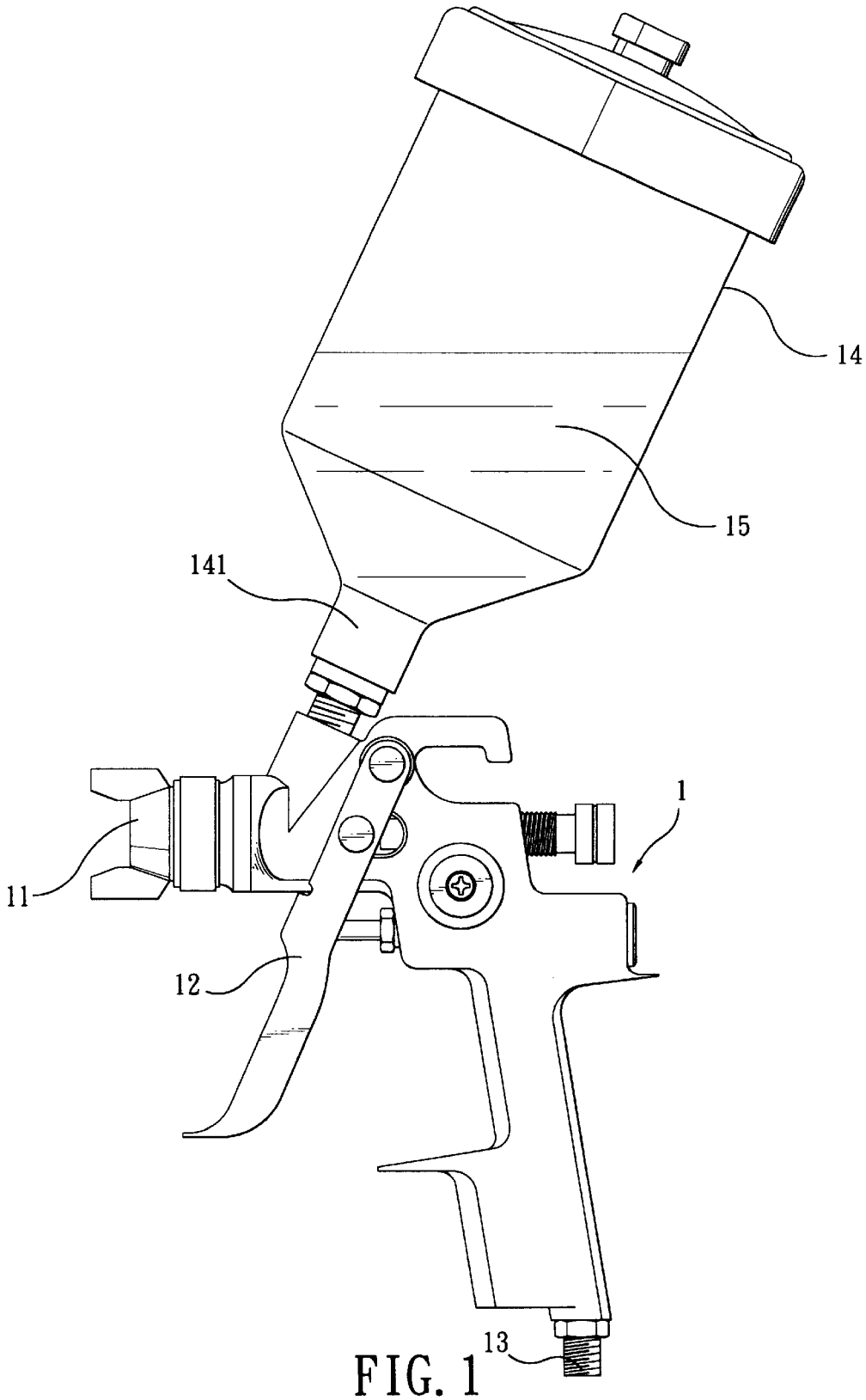
FIG. 1 PRIOR ART
FIG. 1 shows a conventional paint sprayer with a paint cup.
Figure 2:
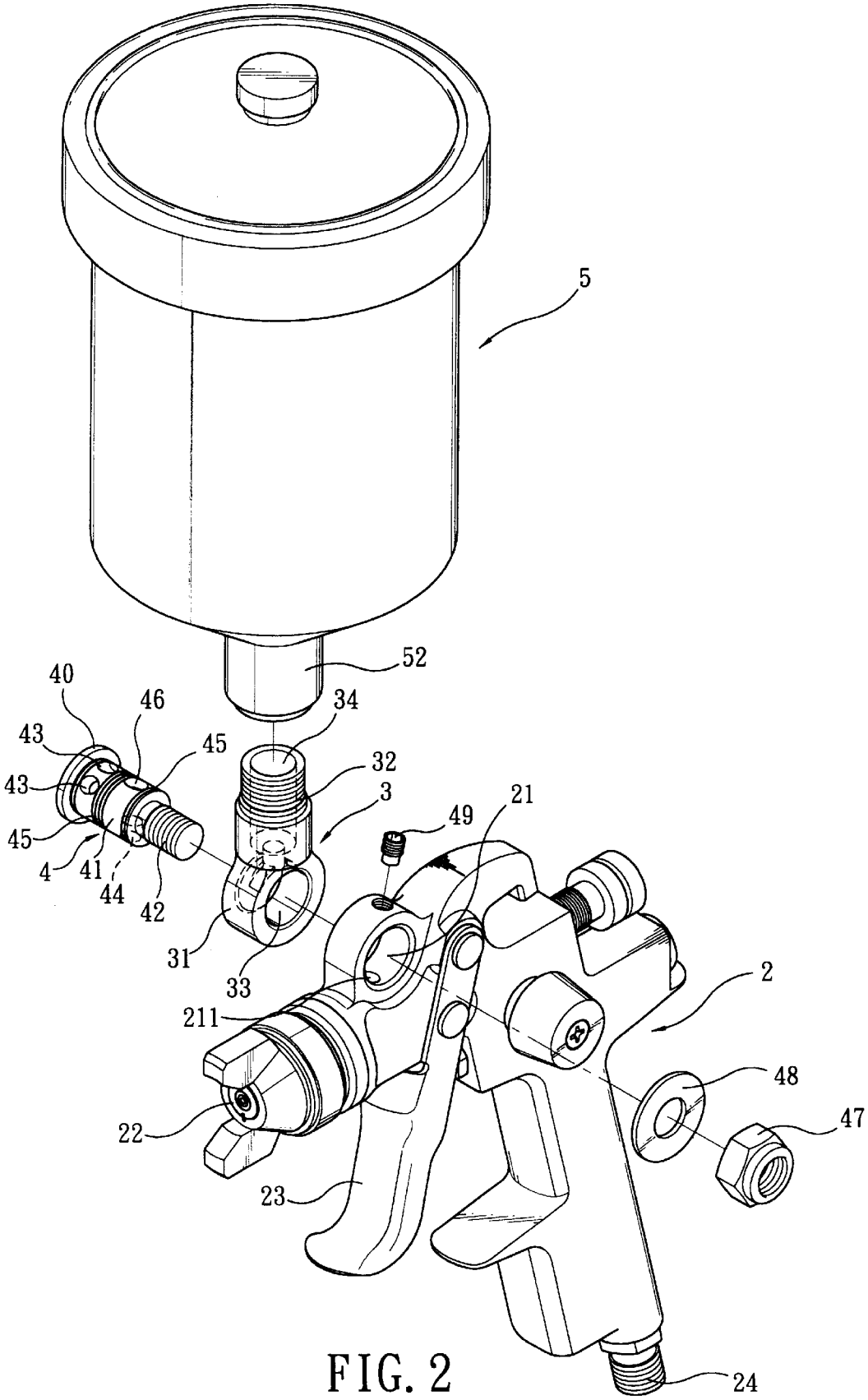
FIG. 2 is an exploded view to show the paint sprayer of the present invention.
Figure 3:
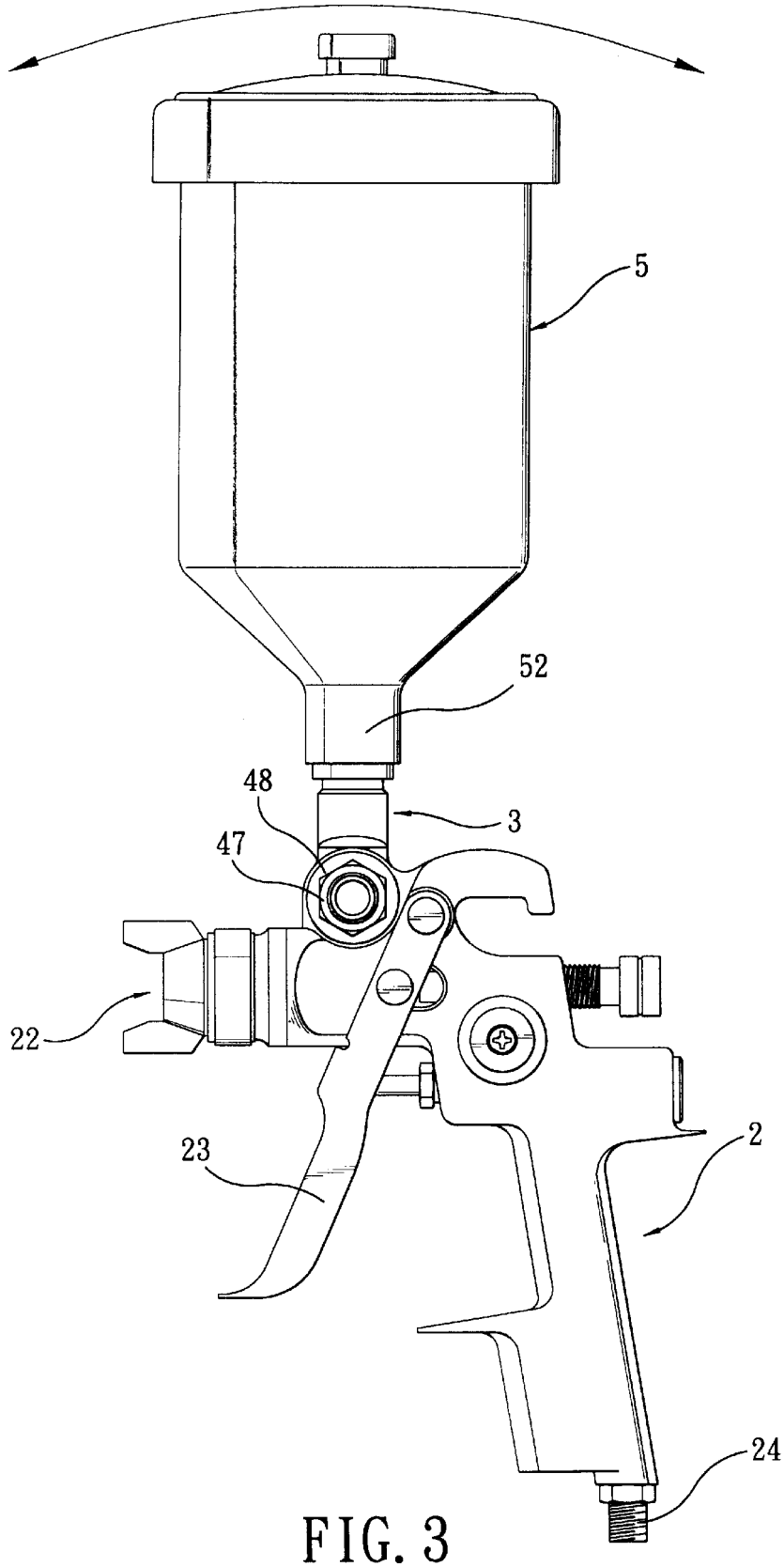
FIG. 3 shows that the cup is pivotable relative to the shaft.
Figure 4:
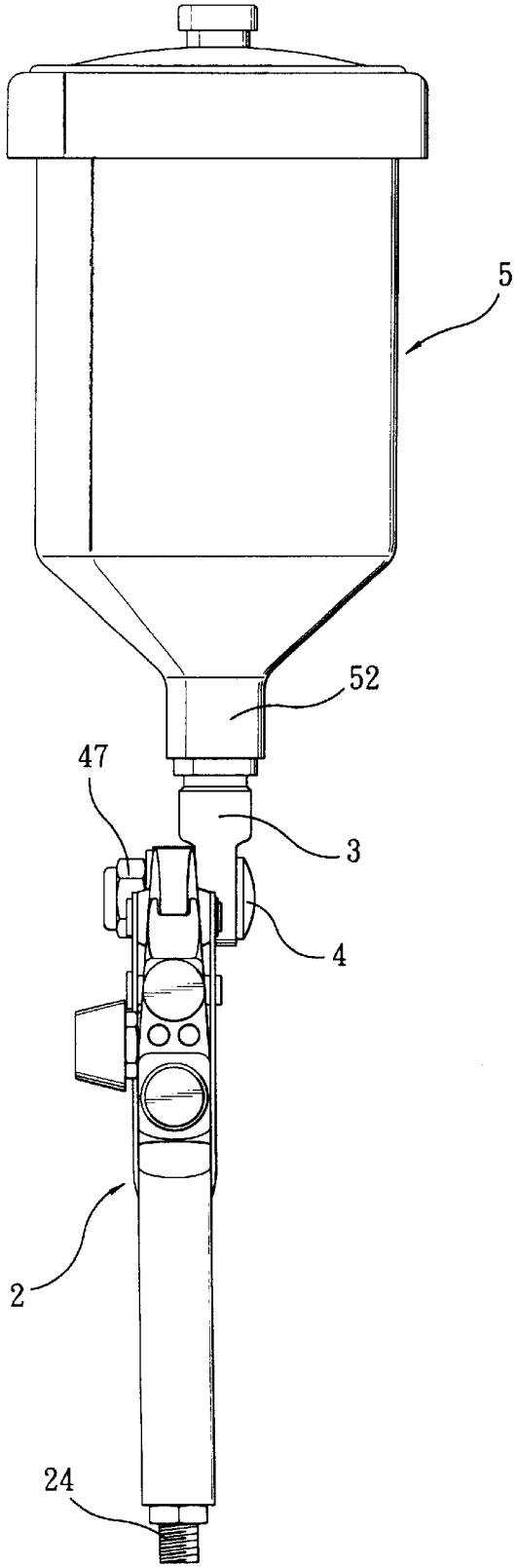
FIG. 4 is an end view to show the paint sprayer of the present invention.

Referring to FIGS. 2 to 4, the paint sprayer of the resent invention comprises a body 2 which has a ring connected to a top edge of the body 2 and including a connection hole 21. A guide hole 211 is defined in through the ring and communicates with an interior of the body 2. A trigger device 23 is pivotably connected to the body 2 so as to control a valve device (not shown) in the body 2 and a hose fitting 24 is connected to the handle of the body 2 and connected to a hose from a compressor (both not shown). A nozzle 22 connected to the body 2 and communicates with the interior of the body 2.

A connection device is pivotably connected between the body 2 and a paint cup 5. The connection device comprises a pivotable member 3 which has an operation portion 31 and a connection portion 32. A hole 33 is defined through the operation portion 31 and a passage 34 is defined through the connection portion 32. The connection portion 32 is connected to a connection neck 52 of the paint cup 5 and the passage 34 communicates with the hole 33 and the interior of the paint cup 5.

A shaft 4 has a head 40 and a hollow shank 41. A securing portion 42 is connected longitudinally to the shank 41. Two inlets 43 and an outlet 44 are defined through a wall of the shank 41. Two seals 45 are mounted to the shank 41 and a position notch 46 is defined in an outer periphery of the shank 41. The shaft 4 extends through the hole 33 of the pivotable member 3 and the connection hole in the body 2. The securing portion 42 extends from the connection hole 21 and a locking member 47 together with a washer 48 are connected to the securing portion 42 to connect the shaft 4 and the pivotable member 3 to the body 2. The pivotable member 3 is pivotable relative to the shank 41 of the shaft 4. The inlets 43 communicates with the passage 34 of the pivotable member 3 and the outlet 44 communicates with the interior of the body 2 so that the paint in the paint cup 5 flows to the body 2 via the passage 34, the inlets 43 and the outlet 44, the guide hole 211.

Figure 5:
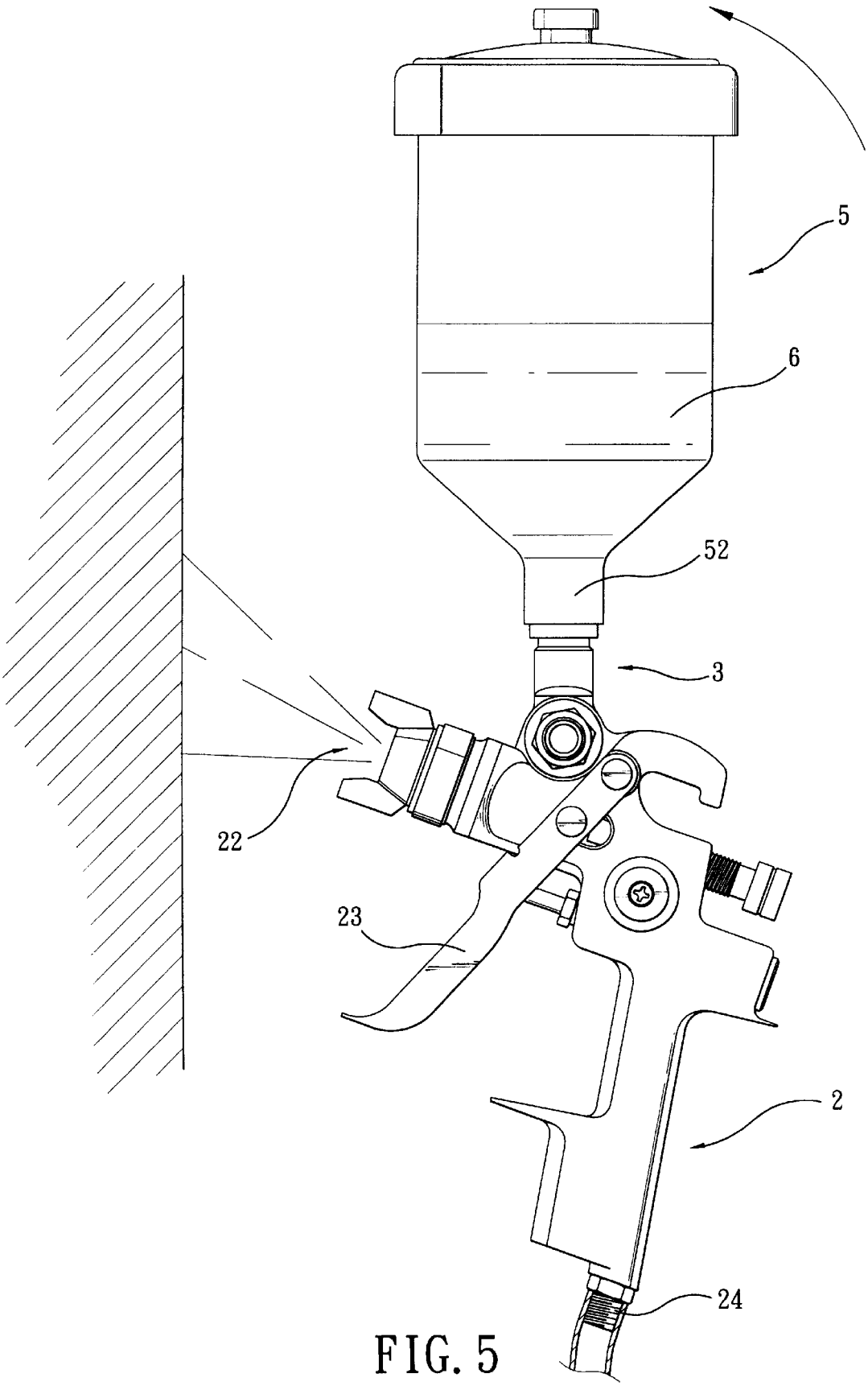
FIG. 5 shows that the paint cup is adjusted when the body of the paint sprayer is operated upward.

A positioning member 49 extends through the ring on the body 2 and is engaged with the positioning notch 46 in the shank 41 so as to position the shaft 4. The operation portion 31 is securely clamped between the ring and the stepped surface of the shank 41 such that when loosening the locking member 47, the pivotable member 3 is pivoted to adjust the position of the paint cup 5 which is secured to the pivotable member 3. As shown in FIG. 5, when the body 2 is used upward, the position of the paint cup 5 is adjusted such that the surface of the paint 6 in the paint cup can be maintained at horizontal. The position of the paint cup 5 is also able to be adjusted such that the surface of the paint 6 in the paint cup can be maintained at horizontal when the body 2 is used downward. The pivotable member 3 can be replaced with a universal joint so as to allow the paint cup 5 to be adjusted more angles and positions.

While we have shown and described the embodiment in accordance with the present invention, it should be clear to those skilled in the art that further embodiments may be made without departing from the scope of the present invention.

What is claimed is:

1. A paint sprayer comprising:

a body having a connection hole, a trigger device and a hose fitting;

a paint cup connected to the body;

a connection device pivotably connected between the body and the paint cup such that the paint cup is pivotable relative to the body, the connection device comprising a pivotable member which has an operation portion and a connection portion, a hole defined through the operation portion and a passage defined through the connection portion, the passage communicating with the hole;

a shaft having a head and a hollow shank, a securing portion connected longitudinally to the shank, an inlet and an outlet defined through a wall of the shank, two seals mounted to the shank and a position notch defined in an outer periphery of the shank, the shaft extending through the hole of the pivotable member and the connection hole in the body, the securing portion extending from the connection hole and a locking member connected to the securing portion to connect the shaft and the pivotable member to the body, the pivotable member being pivotable relative to the shank of the shaft, the inlet communicating with the passage of the pivotable member and the outlet communicating with an interior of the body, and a positioning member extending through the body and engaged with the positioning notch in the shank.

* * * * *